US006811240B2

(12) United States Patent
Chang et al.

(10) Patent No.: US 6,811,240 B2
(45) Date of Patent: Nov. 2, 2004

(54) MANUFACTURING METHOD FOR AN ID CIRCUIT OF INKJET CHIPS

(75) Inventors: Charles C. Chang, Hsinchu Hsien (TW); Jhih-Ping Lu, Hsinchu Hsien (TW)

(73) Assignee: Industrial Technology Research Institute, Hsinchu Hsien (TW)

( * ) Notice: Subject to any disclaimer, the term of this patent is extended or adjusted under 35 U.S.C. 154(b) by 136 days.

(21) Appl. No.: 10/233,395

(22) Filed: Sep. 4, 2002

(65) Prior Publication Data

US 2003/0202028 A1 Oct. 30, 2003

(30) Foreign Application Priority Data

Apr. 30, 2002 (TW) ..... 91108930 A

(51) Int. Cl.[7] ..... B41J 29/393
(52) U.S. Cl. ..... 347/19; 347/56; 347/65
(58) Field of Search ..... 347/19, 65, 50, 347/56; 219/27, 216; 29/890.1; 438/21

(56) References Cited

U.S. PATENT DOCUMENTS 4,872,027 A 10/1989 Buskirk et al. ..... 347/19
5,363,134 A 11/1994 Barbehenn et al. ..... 347/49
5,504,507 A * 4/1996 Watrobski et al. ..... 347/19
5,757,394 A 5/1998 Gibson et al. ..... 347/19
5,831,649 A 11/1998 Watrobski et al. ..... 347/19
5,940,095 A 8/1999 Parish et al. ..... 347/19
6,161,915 A 12/2000 Bolash et al. ..... 347/19
6,675,476 B2 * 1/2004 Hostetler ..... 29/890.1

* cited by examiner

*Primary Examiner*—Hai Pham
*Assistant Examiner*—Lam Nguyen
(74) *Attorney, Agent, or Firm*—Birch, Stewart, Kolasch & Birch, LLP

(57) ABSTRACT

This specification discloses a manufacturing method for an ID circuit of inkjet chips. The method includes the steps of: forming an ID circuit at the predetermined position for an ink feed slot near a print head chip, not cutting or cutting the ID circuit during the ink feed slot processing according to the ID characters to form an ID circuit that is able to recognize the type of the inkjet chip. This method is particularly applicable to monochromic and color print head chips using a shared chip module. The ID circuit is manufactured during the process of making the ink feed slot. Therefore, the manufacturing process is simple without any additional requirement.

7 Claims, 4 Drawing Sheets

MANUFACTURING METHOD FOR AN ID CIRCUIT OF INKJET CHIPS

BACKGROUND OF THE INVENTION

1. Field of Invention

The invention relates to a method of making an ID circuit and, in particular, to a method for making an ID circuit of the inkjet chip in an inkjet printer.

2. Related Art

Since the inkjet print head cartridges for accommodating different inkjet chips may have similar shapes, the printer has to be able to self-test whether the inserted print head is correct to prevent the user from putting the print head into an incorrect carriage. This is the theme of the invention. In particular, for the inkjet chips of a shared chip module, the cartridge, nozzle plate, and TAB for monochromic (black) and multi-color (color) inkjet chips are able to use shared elements so as to keep the cost low while at the same time maintain the quality easily during the later assembly and packaging processes. One drawback, however, is that the print head using a shared inkjet chip is likely to confuse the user so that it is put into an incorrect carriage. Therefore, there is a higher demand for an ID circuit for inkjet chips.

There were several designs of inkjet chip ID available in the prior art. In the U.S. Pat. No. 4,872,027, it was proposed to insert different resistors among different circuit pads of the inkjet chip. If some pads form a loop with low resistance, it then identifies itself as a particular type of inkjet chip. Likewise, if some other pads form a loop, then it is another type of chip.

After active inkjet chips with driving circuits appear, the inkjet chip ID circuit design becomes even more complicated. Nevertheless, the advantage is that no additional circuit connecting points are required. In the U.S. Pat. No. 5,363,134, the ID circuit made use of the address pads originally for controlling the actions of particular nozzles. When some address pad was supplied with a high voltage, the loop resistance passing through the transistor was detected. The loop contained a fuse to define the type of the inkjet chip. If the fuse was kept, then the loop had low resistance; if the fuse was burned, then the loop was open.

In the U.S. Pat. No. 5,831,649, ROM was employed to constitute an N-bit code. In the U.S. Pat. No. 5,757,394, the ID circuit is comprised of a series of transistors. Address lines were used to set ON and OFF of the transistors to read out the code in order. The coding was determined by whether each drain is connected to the gate of the next transistor in the circuit.

In the U.S. Pat. No. 5,940,095, the inkjet chip ID circuit consisted of a series of one-bit shift registers. Each shift register was pre-coded by connecting its source to a high voltage or the ground. To read out the code in order, a parallel load and two clocks were provided.

In addition to chip circuit designs, the U.S. Pat. No. 6,161,915 proposed the design of accompanying the chip circuit with a TAB. When a signal was provided, certain TAB pads would generate a corresponding voltage. Different inkjet chips may be given with the same ID circuit, but the coding of different inkjet chips is determined by covering or uncovering some particular TAB pads.

SUMMARY OF THE INVENTION

It is an objective of the invention to associate different types of inkjet chips with different ID's so that an inkjet printer may easily identify the inkjet chip.

It is another objective of the invention to prepare monochromic and color inkjet chips with a shared chip module through the position arrangement of the ID circuit and the ink feed slot during the formation process of the ink feed slot. This simplifies the manufacturing process of the inkjet chip by having no additional requirements.

The disclosed method does not only apply to the manufacturing of the ID circuit for normal inkjet chips, it is also applicable to the preparation of inkjet chips for a shared chip module. The cartridge, nozzle plate and TAB for monochromic and color inkjet chips can thus be shared. In this case, if the ID circuits of different types of inkjet chips were made by photolithographic process using masks with different patterns, the advantage of a shared chip is sacrificed. Consequently, we install the inkjet chip ID circuit of the shared chip module near the ink feed slot. Subsequent ink feed slot processing makes different ink feed slots for different monochromic and color inkjet chips. At the same time, the inkjet chip ID circuit is disconnected in a particular type of inkjet chip, forming an open-loop ID circuit, whereas it is kept as a closed-loop ID circuit in another type of inkjet chip. Through this kind of circuit structure, it is then possible to identify different types of inkjet chips immediately.

According to the disclosed method, the ID circuit of inkjet chips can adopt the circuits mentioned above. For example, it may be an ID circuit using different resistances, or an ID circuit with transistors. However, the invention further provides a distinct manufacturing method. Based upon the design that monochromic and color inkjet chips of a shared chip module use the same cartridge and TAB, the manufacturing process and structure of existing inkjet chips of a shared chip module are not modified too much. The only difference is that a new method is proposed after the above step for making the ink feed slot and the ID circuit. According to the invention, some circuit of the ID circuit is purposely installed near the ink feed slot of the inkjet chip. Utilizing the size or position of the ink feed slot, the ID circuit is an open or closed loop during the manufacturing process of the ink feed slot, thereby forming an ID circuit that can identify the types of inkjet chips.

BRIEF DESCRIPTION OF THE DRAWINGS

The invention will become more fully understood from the detailed description given hereinbelow illustration only, and thus are not limitative of the present invention, and wherein.

DETAILED DESCRIPTION OF THE INVENTION

The disclosed method mainly forms an ID circuit on an inkjet chip for a printer to recognize the type of the inkjet chip, e.g. identifying whether the inkjet chip is a monochromic or color one.

The method can be implemented through the following steps:

1. An ID circuit is formed at a predetermined position near the ink feed chip;

2. Form an ink feed slot;
3. Connect or disconnect the ID circuit during the manufacturing process of the ink feed slot.

Figure 1:
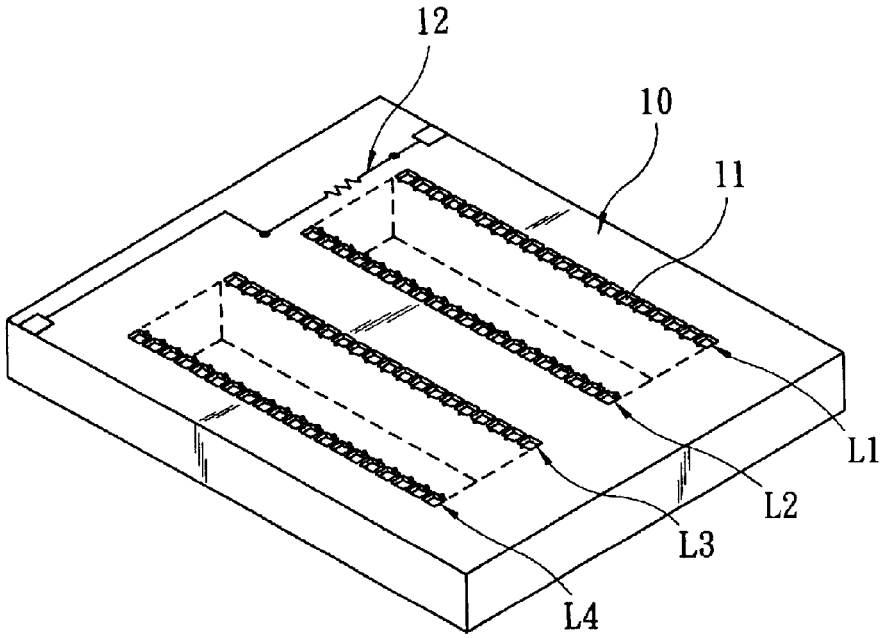
FIG. 1 is a configuration diagram of the ID circuit of an inkjet chip.

In general, the ID circuit is prepared in semiconductor processes. For example, the ID circuit can be made on an inkjet chip through the photolithographic process. As shown in FIG. 1, an inkjet chip 10 has many prepared inkjet holes 11. These inkjet holes 11 are arranged into several parallel lines L1~L4 in the drawing but may be also arranged into some other pattern. In the current embodiment, the predetermined position of the ink feed slot is between the parallel lines L1, L2 and L3, L4 (the position labeled by the dashed line). The ID circuit 12 is formed at a position near the ink feed slot.

Figure 2A:
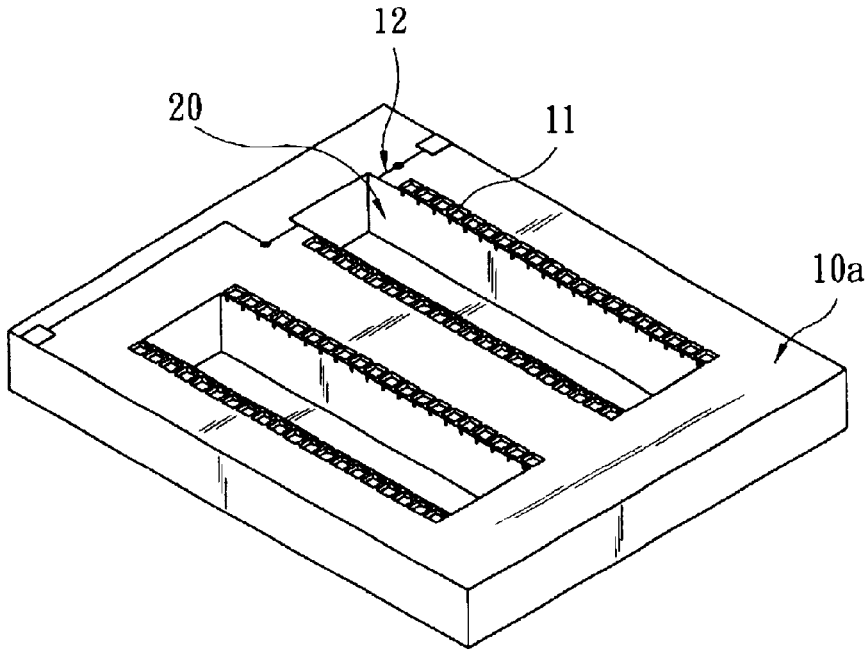
FIGS. 2A and 2B show ID circuit structures of different types of inkjet chips.
Figure 2B:
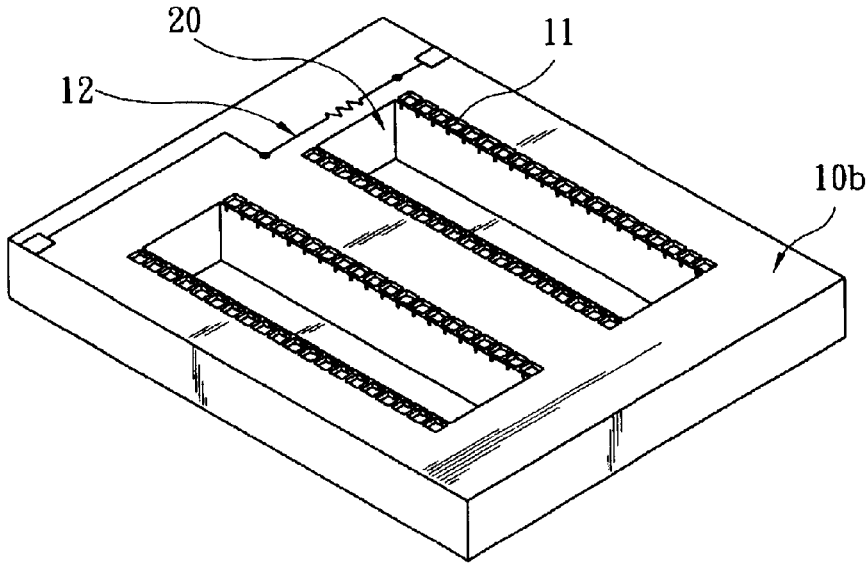

Taking a particular type of inkjet chip 10*a* as an example, in the step of forming the ink feed slot one may employ a sand blasting process to cut a narrow ink feed slot 20 at its predetermined position on the inkjet chip 10*a* (see FIG. 2A). During the sand blasting process for forming the ink feed slot 20, if the circuit of the ID circuit 12 near the ink feed slot 20 is disconnected at the same time, making the ID circuit 12 an open loop, then it can be used to identify this type of inkjet chip 10*a*. On the other hand, if the ID circuit 12 is not disconnected during the sand blasting process, the ID circuit 12 is a closed loop (see FIG. 2B) and it can be used to identify another type of inkjet chip 10*b*.

Figure 3A:
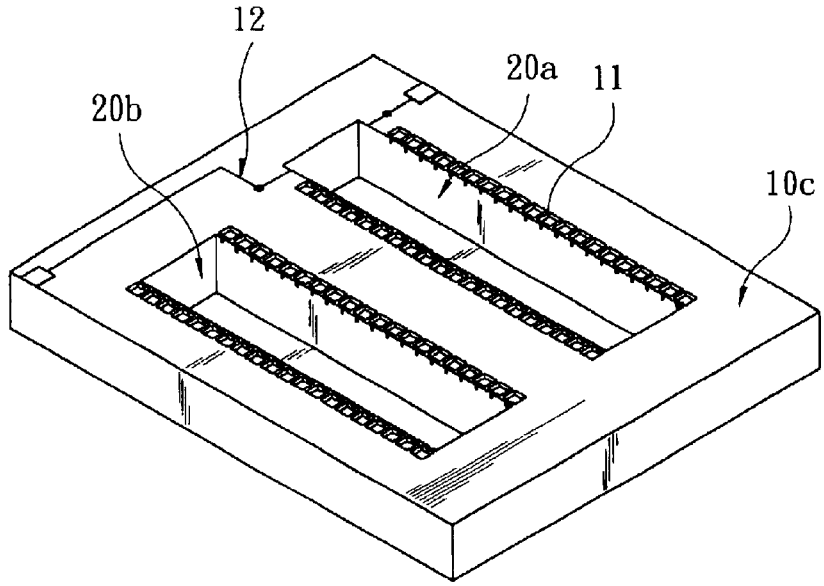
FIGS. 3A and 3B show two ID circuit structures for the inkjet chips using a shared chip module.
Figure 3B:
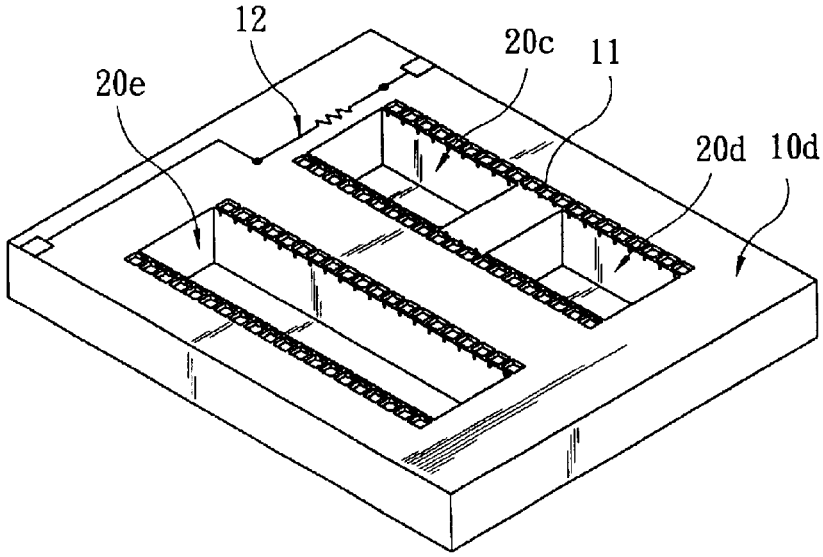

Another embodiment of the invention, shown in FIGS. 3A and 3B, gives two ID circuit structures of the inkjet chips using a shared chip module. 10*c* is a monochromic inkjet chip, and 10*d* is a color inkjet chip. The monochromic print head chip 10*c* has two ink feed slots 20*a*, 20*b* supplying ink of the same color. The color inkjet chip 10*d* has three ink feed slots 20*c*, 20*d*, 20*e* supplying ink of different colors. Likewise, the invention uses a disconnected ID circuit 12 (FIG. 3A) and a connected ID circuit 12 (FIG. 3B) on the monochromic inkjet chip 10*c* and the color inkjet chip 10*d*, respectively, to identify these two types of inkjet chips 10*c* and 10*d*.

In addition to the sand blasting, the ink feed slot 20 can be made using laser cutting, wet etching, and the inductively coupled plasma (ICP) process and their combinations.

Figure 4:
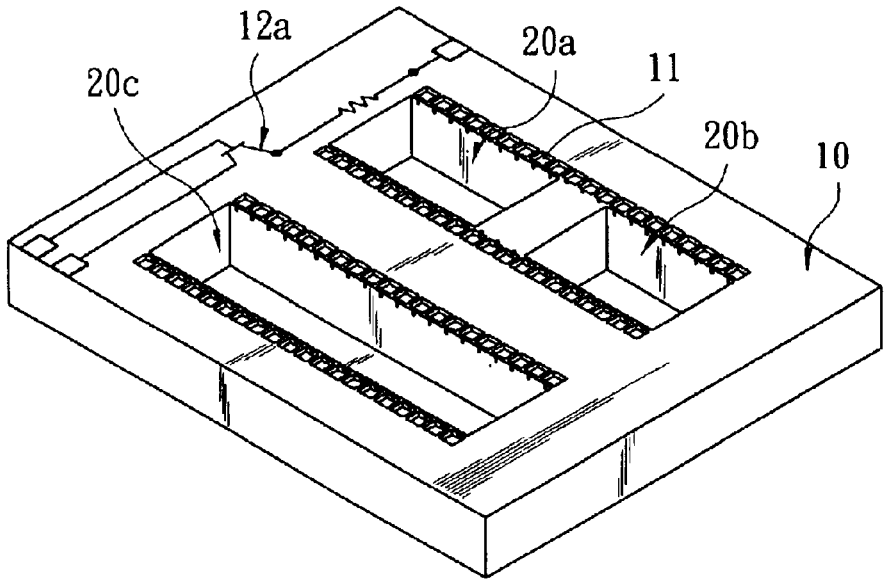
FIG. 4 shows another embodiment of the ID circuit.
Figure 5:
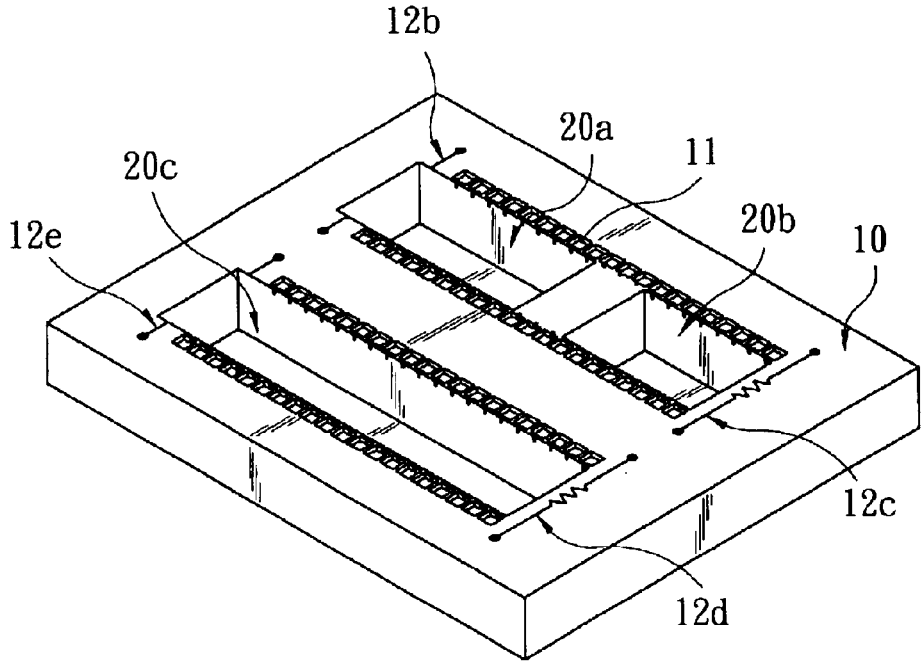
FIG. 5 shows yet another embodiment of the ID circuit.

According to the disclosed method, the ID circuit structure 12 on the inkjet chip 10 can adopt known circuits in the prior art. For example, it can be an ID circuit with or without resistance (FIGS. 2A through 3B), as well as an ID circuit 12*a* with transistors (FIG. 4). In yet another embodiment shown in FIG. 5, an example containing several ID circuits 12*b*~12*e* is illustrated.

Certain variations would be apparent to those skilled in the art, which variations are considered within the spirit and scope of the claimed invention.

What is claimed is:

1. A manufacturing method for the ID circuit of an inkjet chip, which comprises the steps of:

forming an ID circuit at a predetermined position near an ink feed slot of the injet chip; and selectively cutting/not cutting the ID circuit during the machining process of forming the ink feed slot to identify the ink jet chip.

2. The manufacturing method of claim 1, wherein the ID circuit is a resistor loop.

3. The manufacturing method of claim 1, wherein the ID circuit is a circuit containing transistors.

4. The manufacturing method of claim 1, wherein the ink feed slot is formed by sand blasting.

5. The manufacturing method of claim 1, wherein the ink feed slot is formed by laser cutting.

6. The manufacturing method of claim 1, wherein the ink feed slot is formed by wet etching.

7. The manufacturing method of claim 1, wherein the ink feed slot is formed by the inductively coupled plasma.

* * * * *